United States Patent [19]

Minks et al.

[11] Patent Number: 4,675,987

[45] Date of Patent: Jun. 30, 1987

[54] METHOD OF SEALING A RELAY

[75] Inventors: Werner Minks, Heroldsberg; Bernard F. Nitschke, Herzogenaurach, both of Fed. Rep. of Germany

[73] Assignee: International Standard Electric Corporation, New York, N.Y.

[21] Appl. No.: 587,108

[22] Filed: Mar. 7, 1984

[30] Foreign Application Priority Data

Mar. 12, 1983 [DE] Fed. Rep. of Germany ..... 3308791

[51] Int. Cl.[4] ..... H01F 7/06

[52] U.S. Cl. ..... 29/602.1; 29/400 C; 53/404; 53/405; 174/525; 445/43

[58] Field of Search ..... 445/43 R; 53/489, 404, 53/405, 408; 429/171, 632.2; 200/302.1, 306; 220/367, DIG. 27; 29/400 C, 602; 174/17 VA, 525

[56] References Cited

U.S. PATENT DOCUMENTS

| | | | |
|---|---|---|---|
| 2,092,445 | 9/1937 | Doulgheridis | 220/367 |
| 2,522,062 | 9/1950 | Roovers | 445/43 |
| 2,810,889 | 10/1957 | Lundgren | 174/525 |
| 3,040,117 | 6/1962 | Jammet | 29/623.2 |
| 4,035,909 | 7/1977 | Dey | 29/623.2 |
| 4,062,469 | 12/1977 | Rueb | 174/17 VA |
| 4,350,856 | 9/1982 | Shiratori et al. | 174/17 VA |

FOREIGN PATENT DOCUMENTS

| | | | |
|---|---|---|---|
| 843350 | 7/1952 | Fed. Rep. of Germany | 220/367 |
| 2618492 | 8/1976 | Fed. Rep. of Germany . | |

*Primary Examiner*—Percy W. Echols

*Attorney, Agent, or Firm*—T. L. Peterson

[57] ABSTRACT

A relay is sealed with a sealing compound when the relay housing is in a closed state, thus causing an air cushion to be formed in the inside, with an afterflow of sealing compound into the interior being prevented. Following gelling or curing of the sealing compound, a vent hole is pierced into the relay housing which, if required, may be closed following degassing of the interior space of the relay.

1 Claim, 5 Drawing Figures

METHOD OF SEALING A RELAY

BACKGROUND OF THE INVENTION

The present invention relates to a method of sealing a relay.

Published German patent application DE-OS-26 18 492 discloses a relay in which the baseplate, which is overlapped by the rim portion of a cover, is provided with a hump pointing toward the outside. The hump is provided with a central vent hole. Sealing of the relay is effected by means of a fleece (woven fabric) placed onto the baseplate and the lower rim portion of the cover. The fleece is saturated with a curable sealing compound. The hump projects through a recess in the fleece. The vent hole, during the curing, permits pressure equalization within the relay. Following the curing, the vent hole is closed by using a viscous resin or adhesive.

A similar method, not employing a fleece, is disclosed in European Patent Application No. 00 53 870. In both cases, the small vent hole is surrounded on the outside by an enlarged fill-in area.

It is the object of the present invention, to prevent the sealing compound, or an excessive amount of sealing compound, from flowing into the inside of the relay during the sealing process. Yet, the atmosphere of the interior space is to be kept as free as possible from detrimental gasses which particularly occur in the interior space when pouring in the sealing compound.

SUMMARY OF THE INVENTION

According to the present invention, there is provided a method of sealing an electromagnetic relay having an interior space and a cup-like cover extending down to the bottom of a lower housing. A curing or settable sealing compound is applied to the bottom surface of the relay floor when the relay is inverted with the top of the cover pointing downwardly. A vent hole is formed in one wall of the relay after some gelling or curing of the sealing compound for permitting said interior space to be aerated and/or to be degassed and/or to be filled with a gas.

Because the relay housing is sealed in a closed state, the internal pressure of the relay prevents the sealing compound from flowing toward the inside where it is likely to come into contact with the relay components and may thus have a detrimental effect upon the serviceability of the relay or may cause it to become incapable of functioning. Detrimental gasses are permitted to escape through the vent hole in the relay housing which is pierced after some gelling or curing of the sealing compound. Additionally, the interior space may then be degassed and scavenged with an inert gas or filled therewith, whereupon the vent hole is closed. In this way it is possible to obtain a relay having an optimum switching behaviour.

DESCRIPTION OF THE PREFERRED EMBODIMENT

Figure 1:
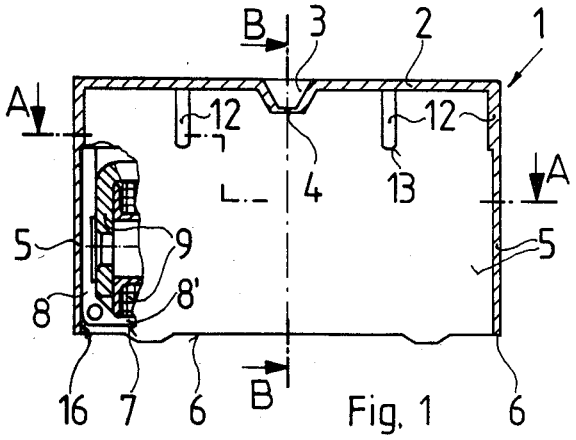
FIG. 1 is a longitudinal sectional view of a cover of a relay with only a portion shown of the relay lower housing member containing the magnet system and the contact system.
Figure 2:
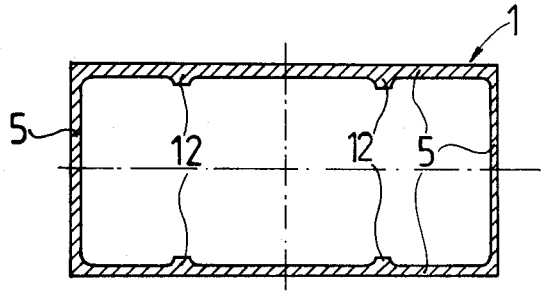
FIG. 2 shows the cover in a horizontal sectional view taken along line A—A of FIG. 1.

In FIG. 1, the reference numeral 1 indicates a cup-shaped cover which is mounted over the lower or inner housing 8 of an electromagnetic relay. The cover may be an injection molded plastic part. In the top 2 of the cover there is provided an inwardly projecting funnel-shaped inlet 3 which opens up toward the outside. The bottom 4 of the inlet 3 is initially closed. The sidewalls 5 of the cover extend downwardly with their end edges 6 to the bottom side 7 of the floor 8' of the housing 8, or even slightly project beyond the bottom side. The housing contains the magnet system 9 and the contact system 10 (FIG. 5) as well as the terminal elements 11 (FIG. 5) of the relay.

Figure 3:
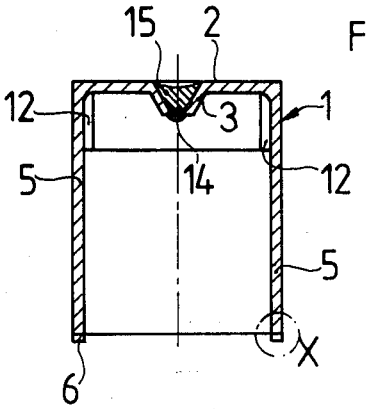
FIG. 3 is a transverse sectional view of the cover taken along line B—B of FIG. 1.

Several ribs 12 are formed on the inside of the cover. The lower ends 13 of the ribs, in the assembled state of the cover, rest on the top of the sidewalls of the housing 8. The bottom 4 of the inlet 3 may be pierced. The thus resulting vent hole 14 may be filled in by a sealing compound 15 (FIG. 3) introduced into the inlet 3. The vent hole 14 is only made so large that the sealing compound, for example, by way of capillary effect and/or surface tension and/or viscosity of the sealing compound, is prevented from dripping down into the interior of the relay. Preferably, the vent hole 14 has a diameter ranging between 0.1 and 0.8 mm, or is designed as a slot having a width ranging between 0.1 and 0.6 mm.

Figure 4:
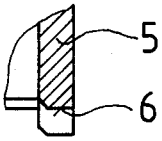
FIG. 4 shows the detail X of FIG. 3 on an enlarged scale.

The inner edge of the lower end edges 6 of the sidewalls 5 of the cover may be chamfered (FIG. 4), thus permitting sealing compound applied to the bottom of the relay to flow better into the separating gap 16 between the sidewalls 5 of the cover and the floor 8' of the housing 8.

Figure 5:
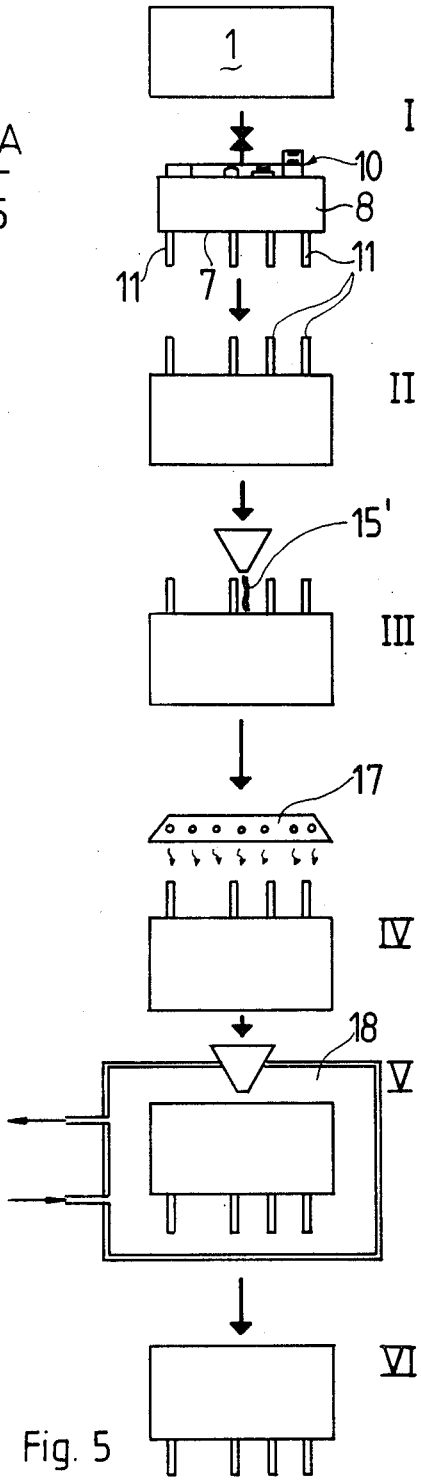
FIG. 5 is a flow chart showing the steps of the method according to the invention.

According to the invention, a sealed relay which is capable of operating effectively over a very large number of switching cycles, is obtained by mounting the cover 1 over the housing 8 after the relay components have been mounted in the housing. (FIG. 5, I). The relay is then inverted so that the top 2 of the cover 1 points in the downward direction (FIG. 5, II). In this position, a self-curing sealing compound 15' or a sealing compound which is curable, for example, by the application of energy is applied to the bottom side 7 of the housing floor 8 (FIG. 5, III). Then the sealing compound 15', by the application of energy, in particular with the aid of a heating device 17, or hot air, etc., is subjected to preferably only slight gelling. Thereafter, the bottom 4 of the funnel-shaped inlet 3 of the cover 1 is pierced, for example, with the aid of a thin needle, thus forming the vent hole 14. If desired, the vent hole 14 may be provided at other points of the relay casing, e.g., in one of the sidewalls 5 of the cover 1 or in a portion of the lower part of the housing 8. If desired, the sealing compound 15' may be completely cured before forming the vent hole 14, but this would result in some delay in the manufacturing procedure.

Any gas inside the interior space of the relay is permitted to escape through the vent hole 14. Thereafter, if required, the vent hole may be closed. If desired, as depicted in FIG. 5, the interior space of the relay may be scavenged with dry air, hydrogen, and/or inert gas, or may be degassed, for example, at an underpressure (vacuum) of up to $10^{-5}$ bar in a low-pressure chamber 18, with the vent hole 14, if necessary, only being closed thereafter. The latter step is carried out, preferably, at an increased temperature, e.g. ranging between 120° and 200° C., especially between 140° and 160° C., and preferably in the normal upright position of the relay. In the course of this step, any constituents which are detrimental with respect to the future operation of the relay, escape from the plastic material of the relay casing. Thereafter, the interior space, preferably after the cooling down to normal temperature, is filled with an inert gas, such as helium, argon or nitrogen, or else with hydrogen or dried air. After this, in the normal upright position of the relay, the sealing compound 15 is introduced into the inlet 3, and the compound is cured to close the vent hole 14.

In this way there is obtained a completely tight relay having very clean contact surfaces and a clean, harmless internal atmosphere assuring a long service life even in the case of a high switching frequency and a very large, e.g. $10^6$, number of switching cycles.

According to an advantageous embodiment of the invention, the wall of the relay, in particular the bottom 4 of the inlet 3, may be pierced by using a heated needle. In this way, no considerable pressure needs to be exerted on the wall when the material of the wall, as intended and used customarily, is formed of a thermoplastic material.

What is claimed is:

1. A method for sealing an electromagnetic rely which includes a housing comprising:

placing a cover over the relay housing and placing a curable sealing material, which emits vapors at a time prior to curing, between adjacent portions of the cover and housing to seal them, wherein the space between the cover and housing is substantially gas tight to resist the flow of sealing material into said space;

curing the sealing material at least partially;

thereafter forming a vent hole in the cover, removing most of the original atmosphere in said space, including vapors of said sealing material, and sealing said vent hole, said step of removing including heating said relay and cover to a temperature of over 120° C.

* * * * *